United States Patent [19]

Suttles et al.

[11] 4,242,970

[45] Jan. 6, 1981

[54] FREE-STANDING ARTICLE SUPPORT UNIT

[75] Inventors: James M. Suttles, Elberton; Terry L. Norton, Royston; Joseph P. Hart, Canon; Thomas C. Jordan, III, Royston, all of Ga.

[73] Assignee: Royston Manufacturing Corporation, Royston, Ga.

[21] Appl. No.: 52,811

[22] Filed: Jun. 27, 1979

[51] Int. Cl.[3] ..... A47F 5/00

[52] U.S. Cl. ..... 108/159; 52/239; 108/108; 211/187

[58] Field of Search ..... 211/187, 193, 189; 52/239, 36; 108/108, 159

[56] References Cited

U.S. PATENT DOCUMENTS

| | | | |
|---|---|---|---|
| 3,587,867 | 6/1971 | Fenwick | 211/187 X |
| 3,602,159 | 8/1971 | Marschak | 211/187 X |
| 3,694,975 | 10/1972 | Pollock | 52/36 |
| 3,714,748 | 2/1973 | Costruba | 52/36 |

*Primary Examiner*—Roy D. Frazier
*Assistant Examiner*—Robert W. Gibson, Jr.
*Attorney, Agent, or Firm*—George A. Smith, Jr.

[57] ABSTRACT

A free-standing shelf support of prefabricated components particularly suited for convenient store or supermarket displays is disclosed. The unit includes two sections each comprising a pair of vertically-disposed uprights mounting therebetween a panel assembly having grooved vertical edges with clips at their upper ends designed to cooperate with slotted tongue protrusions on the uprights to cause the panel assembly to be secured to the uprights simply by being slid downwardly into engagement therewith during assembly. Each upright has a base member which extends laterally from its lower end, and a lower shelf spans across the top of the base members and cooperates with a kickplate extending across the ends of the base members to tie together the lower end of the unit. The uprights are provided with a series of vertically-spaced holes designed to accommodate vertically adjustable shelf supports.

13 Claims, 9 Drawing Figures

FREE-STANDING ARTICLE SUPPORT UNIT

BRIEF SUMMARY OF THE INVENTION

This invention relates to shelf support, and more particularly, to prefabricted, free-standing supports for vertically adjustable shelving. These supports are particularly useful for the display of wares in convenience stores, supermarkets, grocery stores and the like.

Various types of free-standing article support units are known. Examples of such units are disclosed in the following U.S. Pat. Nos. 2,802,291; 2,956,688; 3,085,693; 3,130,693; 3,244,127; 3,263,821 and 3,556,023. Although each of these patented devices may function satisfactorily for its intended purpose, each has certain limitations which are intended to be overcome by the present invention.

In addition to the above-noted patented inventions, a free-standing, double-panel, article supporting display has been commercially available. In this commercial display, a double panel assembly has been provided with extruded plastic vertical edge members designed to cooperate with hollow tubular uprights to mount the panel assembly to the uprights by sliding the panel assembly into engagement therewith. Tabs, depending from an overhanging cap member of the panel assembly, extend downwardly into openings at the upper ends of the hollow uprights to secure the panel assembly to the uprights. This construction has not been entirely satisfactory because of the weakness of the tab design and the need for special plastic edge extrusions.

With the foregoing in mind, a primary object of this invention is to provide a novel, free-standing article support capable of being manufactured economically and erected rapidly with a minimum of special tools and skills.

It is another object of the invention to provide an improved free-standing support for supporting vertically adjustable shelving in convenience stores, supermarkets and the like.

A still further object of the invention is to provide a unique combination of upright and panel edge configurations which cooperate with a novel clip to provide a strong interconnection of a panel assembly with uprights in a freestanding shelving support unit.

The support in accordance with the invention comprises a pair of vertically disposed uprights each having outwardly-offset flanges terminating in spaced confronting relation to provide a slotted tongue extending lengthwise of the upright. A panel assembly is mounted between the uprights and has a pair of vertical edge members formed into a groove for mating engagement with the slotted tongues of the uprights. A clip is mounted at the upper end of each of the panel assembly edge members and has a pair of ears which span across the slotted tongue to engage behind the flanges when the panel assembly is slid vertically downward relative to the uprights during assembly. Base members, secured to the lower ends of the uprights, extend laterally therefrom to support a bottom shelf which spans the tops of the base members. A kickplate is slid downwardly into engagement with the ends of the base members and extends therebetween. The uprights have a series of vertically-spaced slots for accommodating vertically adjustable shelf brackets.

The foregoing and other objects, features and advantages of the invention will become apparent from the following detailed description and the drawings.

DETAILED DESCRIPTION

Figure 1:
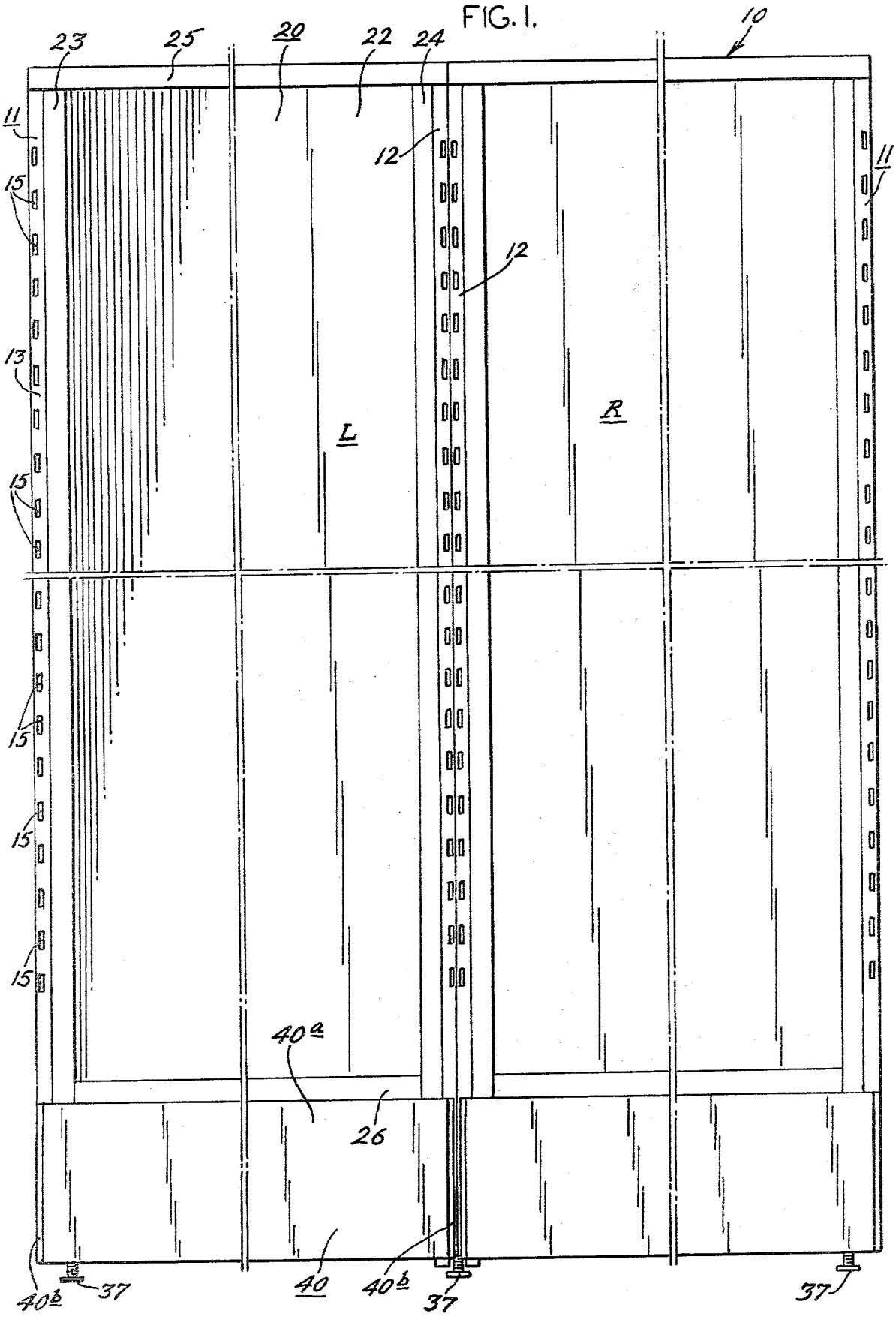
FIG. 1 is a vertically-foreshortened, front elevational view of a free-standing article support which embodies the invention.

Referring to FIG. 1, free-standing article support 10 includes a left section L and a right section R joined together along the vertical median of the unit 10. Since the left and right sections are identical, reference hereinafter will be made to the left section L.

Figures 2, 8, 9:
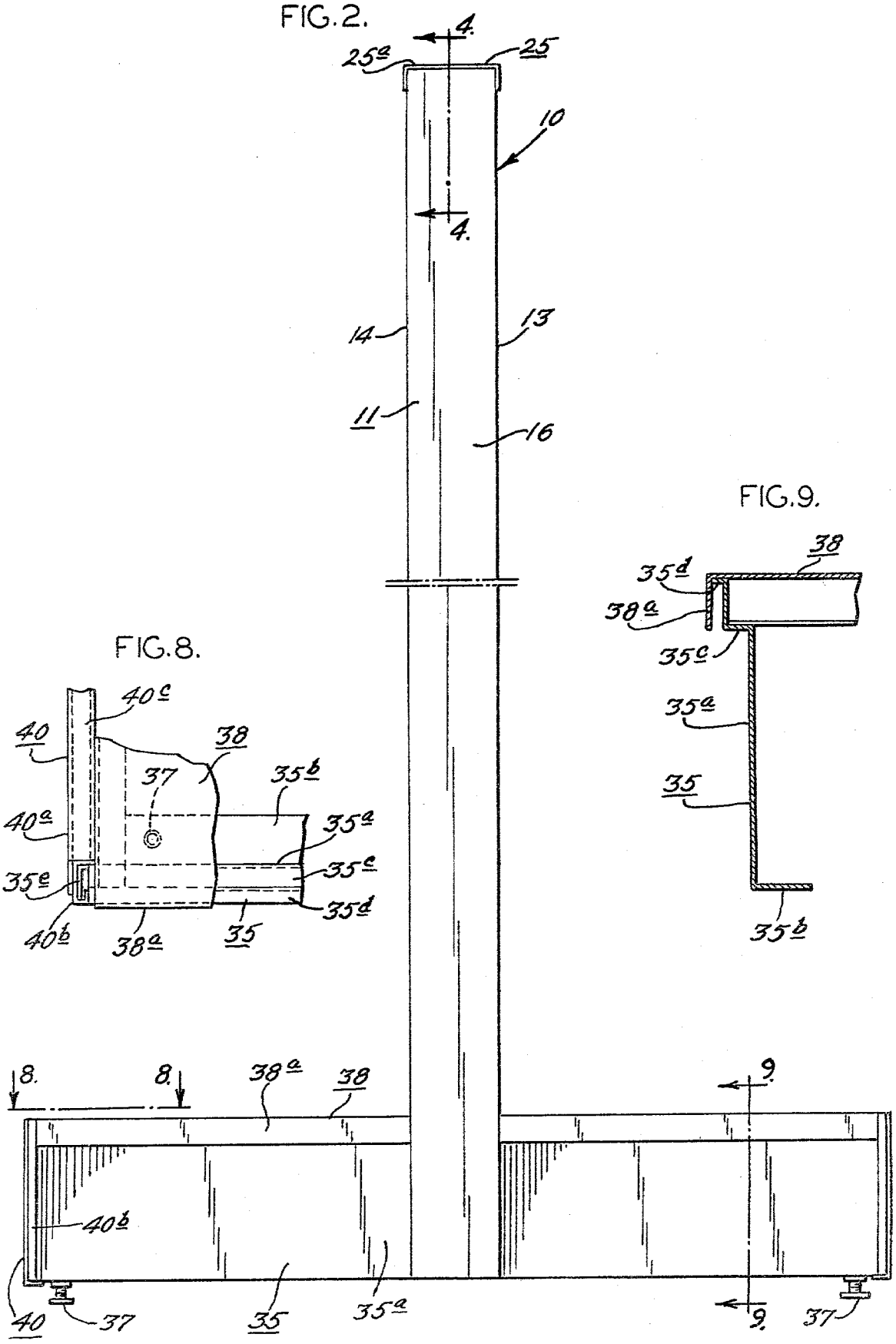
FIG. 2 is an end elevational view thereof.
FIG. 8 is an enlarged fragmentary view taken on plane 8—8 of FIG. 2 to illustrate a portion of the lower shelf and front kickplate.
FIG. 9 is an enlarged sectional view taken on plane 9—9 of FIG. 2.
Figure 3:
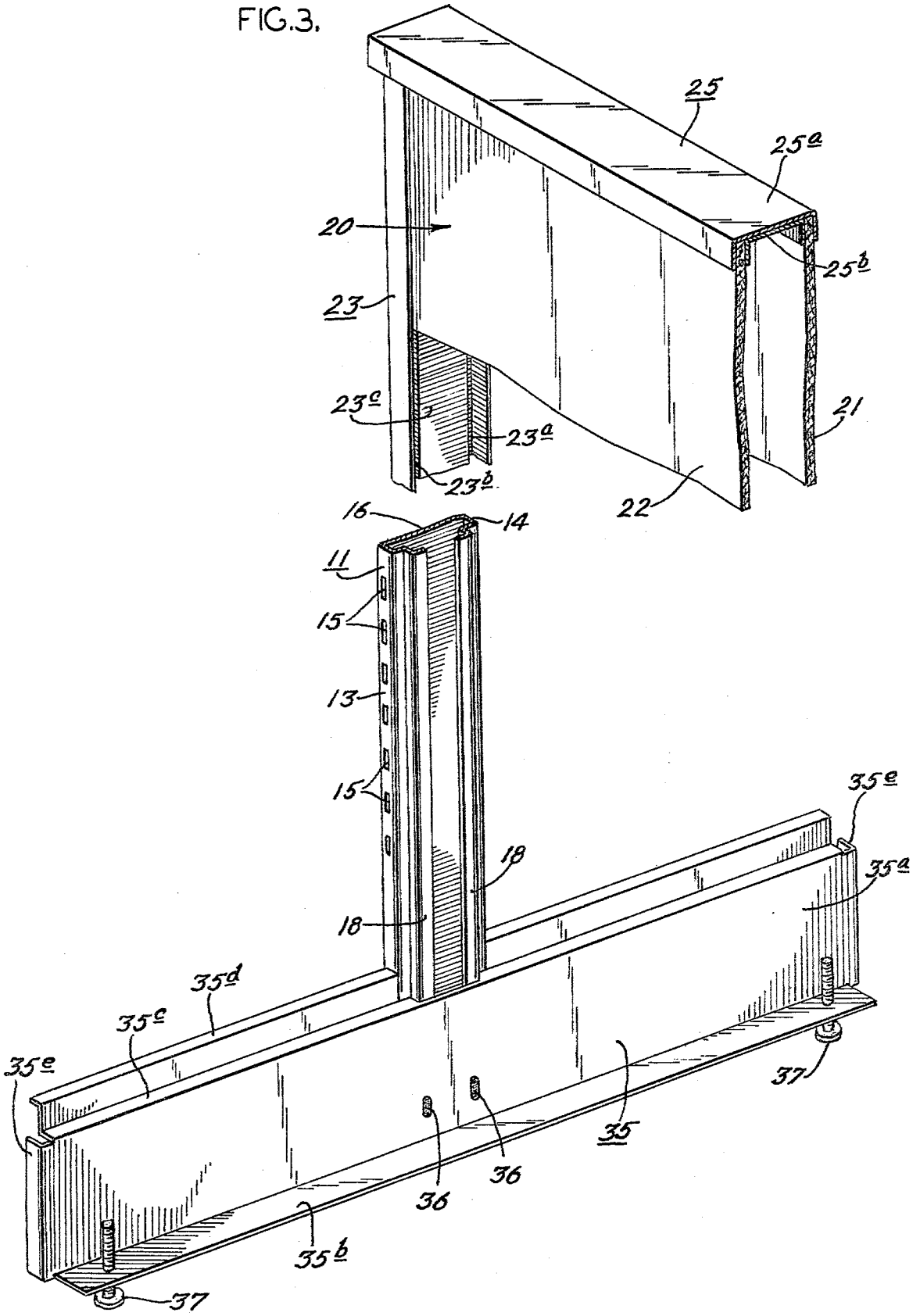
FIG. 3 is a fragmentary perspective view of a portion of the support illustrated in FIG. 1.
Figure 6:
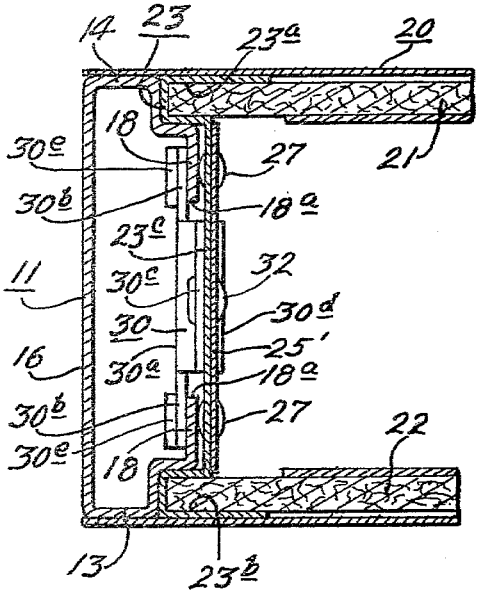
FIG. 6 is a sectional view taken on plane 6—6 of FIG. 4.

The left section L of the support 10 comprises a pair of vertically-disposed, formed sheet metal uprights 11 and 12 in spaced parallel relation. Each upright, such as the upright 11, has front and rear faces 13 and 14, respectively (FIG. 2) each having a series of vertically-spaced slots 15 for accommodating conventional cantilevered shelf brackets (not shown). As best seen in FIGS. 3 and 6, the front and rear apertured faces 13 and 14 are connected together by an imperforate web 16. In the embodiment illustrated in FIG. 1, the webs 16 of the central uprights 12 are disposed flush against one another and welded together to provide a double upright extending along the vertical median of the support 10 to tie the left and right sections together.

Figure 7:
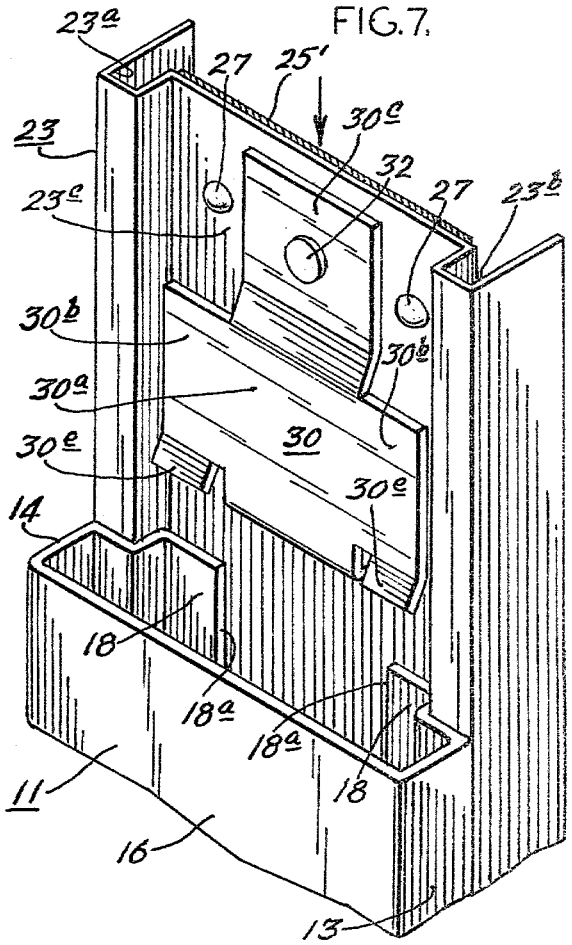
FIG. 7 is a fragmentary perspective view, in partial section with panels removed, illustrating a panel assembly edge member and clip prior to interengagement with an upright; p

A panel assembly 20 spans between and is mounted to the uprights 11 and 12. To this end, as best seen in FIG. 7, the upright 11 has a pair of outwardly-offset flanges 18 having edges **18*a* disposed in space confronting relation to provide a relatively wide elongated slotted tongue running lengthwise of the upright for cooperating with the panel assembly 20. The panel assembly 20 comprises a pair of rigid panels 21 and 22 (FIG. 3) mounted in spaced parallel relation by means of a pair of edge members 23 and 24. These panels are typically perforated or unperforated wood particle composition board panels. As best seen in FIG. 7, each edge member, such as edge member 23, is fabricated of sheet metal and is shaped to provide a pair of channels 23*a* and 23*b* which receive the vertical edges of the panels 22 and 21, respectively. Edge member 23 has a recessed web portion 23*c* which cooperates with channels 23*a* and 23*b* to define a groove running lengthwise of edge member 23. The groove is shaped for mating engagement with the slotted tongue of upright 11 is the manner illustrated in FIG. 7**. The tongue-and-groove engagement of upright 11 and edge member 23 allows relative vertical sliding of the two members, but prevents relative movement in directions perpendicular to the panels. The tongue-and-groove arrangement also serves as a reinforcement for the uprights so that the presence of the lengthwise slots in the tongues does not seriously impair the strength of the uprights when the support is fully assembled. The lengthwise slots therefore, serve to reduce the weight of the uprights without materially weakening them. These slots also serve to secure the panel assemblies to the uprights, as will become apparent.

Figure 4:
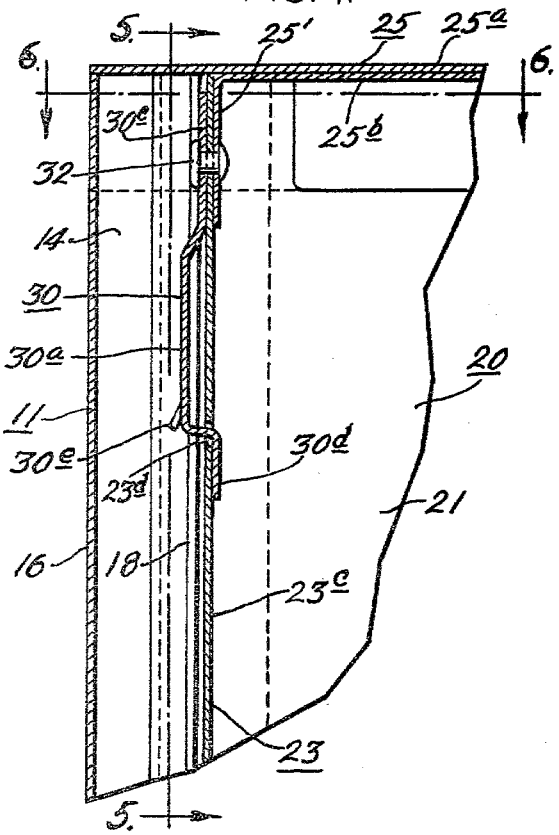
FIG. 4 is an enlarged sectional view taken on the plane 4—4 of FIG. 2 to illustrate a clip which secures one edge of the panel assembly to one of the uprights.

The top and bottom edges of the panels 21 and 22 are received in upper and lower caps 25 and 26 respectively. In the present instance, each cap, such as the upper cap 25 (FIG. 3) includes an outer channel member 25*a* and an inner narrower channel member 25*b* secured thereto. The downturned flanges of the channel members 25*a* and 25*b* cooperate to define a pair of slots running lengthwise of the top cap 25 to receive the edges of the panels 21 and 22. As best seen in FIG. 4, opposite ends of the inside channel member 25*b* are provided with downturned tabs 25′ which are fastened to the edge members 23 as by a pair of rivets 27 (FIGS. 6 and 7). The lower cap 26 is similarly constructed and connected to the edge members 23. Thus, edge members 23 cooperate with the panels 21 and 22 and the upper and lower caps to provide a unitary panel assembly. Outer channel 25*a* of the top cap 25 extends a slight distance beyond the edge members 23 to extend over the tops of the uprights 11 and 12 as illustrated in FIGS. 3 and 4.

Figure 5:
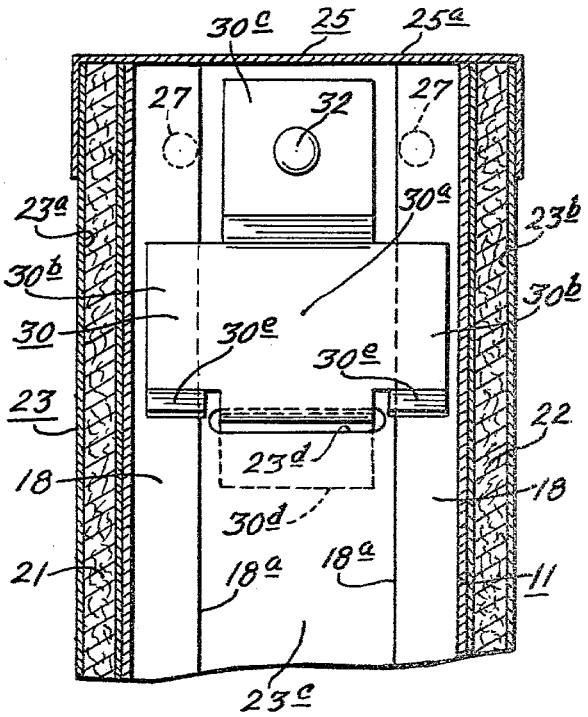
FIG. 5 is a sectional view taken on plane 5—5 of FIG. 4.

The panel assemblies are securely fastened to the uprights by simply pushing them downwardly relative to the uprights during assembly. To this end, a clip 30 is mounted on each edge member 23, as illustrated in FIG. 7. Clip 30 is designed to cooperate with the flanges 18 forming the slotted tongue of the upright 11 to fasten the panel assembly 20 securely to the upright. In the illustrated embodiment, clip 30 has a central web 30*a* and a pair of integral ears 30*b* extending outwardly from the web 30*a*. These ears span the slot between the flanges 18 of the upright 11 and engage the insides of flanges 18 in the manner illustrated in FIGS. 5 and 6. Clip web 30*a* has a necked-down upper-mounting flange 30*c* which is offset from the plane of the web 30*a* and fastened to edge member 23 by a rivet 32 to space the clip web 30*a* from recessed web 23*c* of edge member 23 a distance corresponding substantially to the thickness of flanges 18*a*. As shown in FIG. 7, ears 30*b* have cam surfaces 30*e* bent outwardly from the plane of the web 30*a* to facilitate initial engagement of the clip 30 with the upright 11. As best seen in FIG. 4, clip web 30*a* has a lower necked-down dog-legged mounting flange 30*d* shaped to be received in a horizontal slot 23*d* in the web 23*c* of the edge member 23. Thus, the dog-legged lower mounting flange 30*d* cooperates with the edge member 23 to prevent the lower end of the clip 30 from being pulled away from the panel assembly. As a result, the clip 30 is able to withstand substantial stresses which may be inadvertently applied to it by workmen accidentally pulling outwardly on the bottoms of the uprights 11 and 12 during assembly.

The uprights 11 and 12 are tied together along their bottoms to provide a rigid free-standing structure. To this end, a base member 35 extends laterally outward from the bottom of each upright, such as the upright 11 in the manner illustrated in FIG. 3. In the illustrated embodiment, the base member 35 extends in the opposite directions from the front and the rear of the upright 11. However, it should be understood that in a support unit for use against a wall, where only the front is to be used to support shelving, the rear section of the base member may be eliminated and its foot located under the upright 11. As best seen in FIG. 3, the base member 35 has a vertically-disposed web 35*a* engaged flush against the flanges 18 of the upright and secured thereto by plug welds 36. The base member 35 has a lateral flange 35*b* extending longitudinally along its lower edge for mounting a pair of vertically adjustable feet 37. As best seen in FIG. 9, base member 35 has a pair of vertically-spaced offset shoulders 35*c* and 35*d* extending along its upper edge and interrupted centrally to engage the front and rear faces of upright 11 to ensure orthogonal mounting of upright 11 to base member 35. Base member 35 may be welded to upright 11 along their lines of juncture to provide further stiffening. The base members 35 are tied together by means of a lower shelf 38 which rests on the upper shoulders 35*d* of the base members 35 and has a downturned flange 38*a* at opposite ends. See FIG. 9. Thus, the lower shelf 38 spans the adjacent base members 35 and ties together the support unit 10 adjacent the bottoms of the uprights 11 and 12.

In order further to tie together the bottom of the support unit, and to provide a frontal trim piece, a kickplate 40 is provided. Kickplate 40 is designed to slide vertically downward into engagement with the ends of the base members 35. In the illustrated embodiment, kickplate 40 includes a vertically-disposed web 40*a* on the opposite ends of which are mounted generally C-shaped fittings 40*b* extending vertically from top to bottom and welded to the edge margin of the kickplate web 40*a* in the manner illustrated in FIG. 8. Web 40*a* has upper and lower reversely-turned flanges extending lengthwise along its upper and lower edges, such as upper flange 40*c*. Opposite ends of base member web 35*a* are provided with outturned vertical flanges 35*e* (FIG. 3) which slidably receive the end fittings 40*b* of the kickplate 40, as illustrated in FIG. 8. The reversely-turned upper flange 40*c* of kickplate 40 engages the top of the base member web 35*a* adjacent flange 35*e* to limit downward movement of the kickplate 40. Thus, the kickplate 40 can be installed across the ends of the base members 35 simply by sliding the kickplate 40 vertically downward either before or after the lower shelf 38 has been installed.

To assemble the various components of the support unit, the end upright 11 is spaced from the central upright 12, and the left panel assembly L is slid vertically downward to cause the clips 30 to interengage with the flanges 18 of the uprights 11 and 12 adjacent their upper ends and to cause the end extensions of the top cap 25*a* to engage the tops of the uprights 11 and 12. Thereafter, the assembly may be levelled by appropriately rotating the adjustable feet 37, and the lower shelf 38 may be installed before or after the kickplate 40 is applied. The right panel assembly R may then be installed in a similar manner, or vice versa.

A series of support units may be placed end-to-end to provide a row of whatever length desired. In such a series, the intermediate uprights correspond to the intermediate back-to-back welded uprights in FIG. 1 while the terminating uprights correspond to simple upright 11.

After the assembly of the support unit or series of supports is completed, shelving brackets designed to interfit with the holes 15 in the uprights may be installed and appropriate shelving placed on the brackets to complete the assembly.

In view of the foregoing, it will be apparent that the invention now provides a sturdy free-standing support specifically designed to accommodate vertically adjustable shelving such as may be found in a convenience store or supermarket display. The support can be manufactured economically on conventional brake presses and roll-forming equipment by high-speed production techniques, and can be erected expeditiously by store personnel and other workmen having a minimum of special skills and tools. Accordingly, the invention is commercially more desirable than known prior art shelf support units.

While a preferred embodiment of the present invention has been described in detail, various modifications, alterations and changes may be made without departing from the spirit and scope of the present invention as defined in the appended claims.

We claim:

1. A free-standing article support comprising:

a pair of vertically-disposed uprights, each having a pair of outwardly-offset flanges terminating in spaced confronting relation to form a slotted tongue;

a panel assembly having a pair of edge members, each formed into a groove for matingly receiving the slotted tongues of the respective uprights to mount said uprights and panel assembly in a common plane;

a clip mounted to each edge of said panel assembly adjacent its upper end for engaging in said slotted tongue and behind said flanges upon downward movement of said panel assembly;

a base member extending laterally from the bottom of each upright;

a lower shelf spanning across the tops of said base members;

a kickplate extending across the ends of said base members; and means on said kickplate and said base members for securing said kickplate to said base members upon downward movement of said kickplate.

2. An article support according to claim 1 wherein said clip has a web with pair of ears extending across said slotted tongue to engage behind said flanges, and including means mounting said web offset a slight distance from said edge to accommodate the thickness of said upright flanges and adapted to be received in said slotted tongue.

3. An article support according to claim 3 wherein said clip has a web with pair of ears extending across said slotted tongue to engage behind said flanges, and including means mounting said web offset a slight distance from said edge to accommodate the thickness of said upright flanges and adapted to be received in said slotted tongue, and means providing an outturned foot on each ear to facilitate initial engagement of the clip with the top of said slotted tongue.

4. An article support according to claim 1 wherein said panel assembly includes a pair of panels disposed in spaced parallel relation, and each of said edge members has a pair of channels receiving the edges of the panels and a connecting web inset from the panel edges to cooperate with said channels to form said groove for matingly engaging the slotted tongue of said upright.

5. An article support according to claim 1 wherein said panel assembly includes a pair of panels disposed in spaced parallel relation, and including caps extending along the top and bottom edges of said panels, each of said caps including inner and outer inverted channel members of different widths connected together to form separate channels for receiving the top and bottom edges of said panel, said inner channel member having a downturned terminal flange at opposite ends fastened to said panel assembly edge member, and said outer channel member of said top cap extending across the tops of the uprights.

6. An article support according to claim 1 wherein each base member has a vertically-disposed outturned flange, and said kickplate has a pair of reversely-turned end fittings at opposite ends slidably engaging said outturned flanges.

7. An article support according to claim 1 wherein each base member has an upstanding web extending in opposite directions across the slotted tongue of the upright and has a pair of vertically-offset centrally-interrupted outturned flanges enabling the flanges ofthe upright to be engaged flush against said base member web and fastened thereto.

8. In a free-standing article support including a pair of vertically-disposed uprights, means at the bottom of each upright providing a base extending laterally therefrom, a panel assembly disposed between said uprights and having opposite vertical edges extending therealong, means extending adjacent the bottom of the panel assembly to tie the uprights together, and means for connecting the panel assembly to the uprights, the improvement wherein said connecting means comprises: a clip carried on each edge of said panel assembly, and flange means on each upright slidably engaging each clip, said flange means including a pair of inturned flanges terminating in spaced confronting relation to define therebetween an upwardly-open slot, and said clip having a web mounted to said panel edge and a pair of ears extending laterally of said web, said web being sized to be received in said slot and said ears engaging the across and behind said upright flanges.

9. An article support according to claim 8 in which said ears have cam surfaces bent away from the panel edge, whereby downward movement of the panel relative to the uprights causes the clips to engage the uprights.

10. An article support unit according to claim 8 in which said inturned flanges on each upright are offset to form a tongue and in which each of the opposite vertical edges of the panel assembly is formed into a groove, each tongue being in mating engagement with a groove on the panel assembly.

11. An article support according to claim 8 wherein said clip web is mounted to said panel assembly edge adjacent its upper end.

12. An article support according to claim 11 wherein said clip web has upper and lower mounting flanges, said upper mounting flange being offset from the plane of the web to dispose said ears a distance outwardly from said panel assembly edge corresponding substantially to the thickness of said upright flanges, and means fastening said clip flanges to said panel assembly edge.

13. An article support according to claim 12 wherein said lower clip flange mounting means includes a slot in said panel assembly edge member and said lower clip flange has a dog-leg extending through said slot to engage inside said edge member.

* * * * *

UNITED STATES PATENT AND TRADEMARK OFFICE

CERTIFICATE OF CORRECTION

PATENT NO. : 4,242,970

DATED : January 6, 1981

INVENTOR(S) : James M. Suttles, Terry L. Norton, Joseph P. Hart, Thomas C. Jordan, III It is certified that error appears in the above-identified patent and that said Letters Patent are hereby corrected as shown below:

Column 1, line 7, "prefabricted" should be --prefabricated--

Column 2, line 22, "p" should be deleted

Column 2, line 22, "FIG. 8" should start a new paragraph

Column 2, line 51, "space" should be --spaced--

Column 5, line 51, "claim 3" should be --claim 1--

Column 6, line 20, "ofthe" should be --of the--

Column 6, line 41, "the" should be deleted

Signed and Sealed this

*Twenty-fourth* Day of *March 1981*

[SEAL]

*Attest:*

RENE D. TEGTMEYER

*Attesting Officer*

*Acting Commissioner of Patents and Trademarks*